US011906172B1

(12) United States Patent
Santana et al.

(10) Patent No.: US 11,906,172 B1
(45) Date of Patent: Feb. 20, 2024

(54) COOKTOP APPLIANCE VAPORIZATION-RESPONSIVE CLOSED-LOOP-CONTROLS

(71) Applicant: Haier US Appliance Solutions, Inc., Wilmington, DE (US)

(72) Inventors: Omar Santana, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/873,715

(22) Filed: Jul. 26, 2022

(51) Int. Cl.

| | |
|---|---|
| ***F24C 3/12*** | (2006.01) |
| ***F24C 3/08*** | (2006.01) |
| ***F23N 1/00*** | (2006.01) |
| ***F23N 5/14*** | (2006.01) |

(52) U.S. Cl.
CPC ..... *F24C 3/126* (2013.01); *F23N 1/005* (2013.01); *F23N 5/143* (2013.01); *F24C 3/085* (2013.01); *F23N 2225/16* (2020.01); *F23N 2239/04* (2020.01); *F23N 2241/08* (2020.01)

(58) Field of Classification Search
CPC ..... F24C 3/126; F24C 3/085; F24C 3/122; F24C 3/124; F23N 5/143; F23N 1/005
USPC .... 126/52, 39 R, 39 E, 374.1, 388.1; 99/331
See application file for complete search history.

(56) References Cited

U.S. PATENT DOCUMENTS

| | | | | |
|---|---|---|---|---|
| 2020/0178357 | A1* | 6/2020 | Christiansen ..... | F24C 3/126 |
| 2021/0172602 | A1 | 6/2021 | Billman et al. | |

FOREIGN PATENT DOCUMENTS

| | | | |
|---|---|---|---|
| CA | 2789247 | A1 | 8/2011 |
| EP | 1021979 | B1 | 3/2004 |

* cited by examiner

*Primary Examiner* — Vivek K Shirsat
(74) *Attorney, Agent, or Firm* — Dority & Manning, P.A.

(57) ABSTRACT

A method of operating a cooktop appliance in a precision mode includes monitoring a temperature with a temperature sensor and starting a vaporization timer when the monitored temperature enters a vaporization band. The method also includes freezing the precision mode when the vaporization timer expires and the monitored temperature is within the vaporization band.

20 Claims, 5 Drawing Sheets

COOKTOP APPLIANCE VAPORIZATION-RESPONSIVE CLOSED-LOOP-CONTROLS

FIELD OF THE INVENTION

The present subject matter relates generally to cooktop appliances, including cooktop appliances configured for precise temperature control.

BACKGROUND OF THE INVENTION

Cooktop appliances generally include heating elements for heating cooking utensils, such as pots, pans and griddles. A user can select a desired heating level, and operation of one or more of the heating elements is modified to match the desired heating level. For example, certain cooktop appliances include electric heating elements. During operation, the cooktop appliance operates the electric heating elements at a predetermined power output corresponding to a selected heating level. As another example, some cooktop appliances include gas burners as heating elements. During operation, the heat output of the gas burner is modulated by adjusting a position of a control valve coupled to the gas burner.

Some cooktop appliances are operable in a precision mode, which generally uses a closed-loop control algorithm to vary the output of the heating element in response to the desired heating level and a measured temperature, e.g., of or at the cooking utensil. Typical closed-loop control algorithms are generally based on the measured temperature, which is not always a reliable indicator of the thermal energy in the cooking utensil and contents thereof. For example, when the items in the cooking utensil have a significant amount of water or other moisture content, the latent heat of vaporization of such moisture content may result in a stalled temperature increase even as the heat increases while the moisture is vaporizing. In such cases, the typical closed-loop algorithm may not produce the desired results, e.g., the typical closed-loop algorithm may call for an excessively high power level.

Accordingly, a cooktop appliance with features for improved precision temperature control, e.g., that is more responsive to vaporization of moisture from items being cooked, would be useful.

BRIEF DESCRIPTION OF THE INVENTION

Aspects and advantages of the invention will be set forth in part in the following description, or may be apparent from the description, or may be learned through practice of the invention.

In one example embodiment, a cooktop appliance includes a user interface. The cooktop appliance also includes a heating element positioned at a cooking surface of the cooktop appliance and a temperature sensor configured to measure a temperature at a utensil heated by the heating element. The cooktop appliance further includes a controller. The controller is configured for receiving a user-determined set temperature from the user interface, receiving a precision mode initiation signal, and receiving a temperature measurement from the temperature sensor. The controller is also configured for monitoring the temperature at the utensil heated by the heating element with the temperature sensor and starting a vaporization timer when the monitored temperature enters a vaporization band. The controller is further configured for freezing the precision mode when the vaporization timer expires and the monitored temperature is within the vaporization band.

In another example embodiment, a method of operating a cooktop appliance is provided. The method includes receiving a user-determined set temperature from a user interface of the cooktop appliance, receiving a precision mode initiation signal, and receiving a temperature measurement from a temperature sensor configured to measure a temperature at a utensil heated by a heating element positioned at a cooking surface of the cooktop appliance. The method also includes monitoring the temperature at the utensil heated by the heating element with the temperature sensor and starting a vaporization timer when the monitored temperature enters a vaporization band. The method further includes freezing the precision mode when the vaporization timer expires and the monitored temperature is within the vaporization band.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
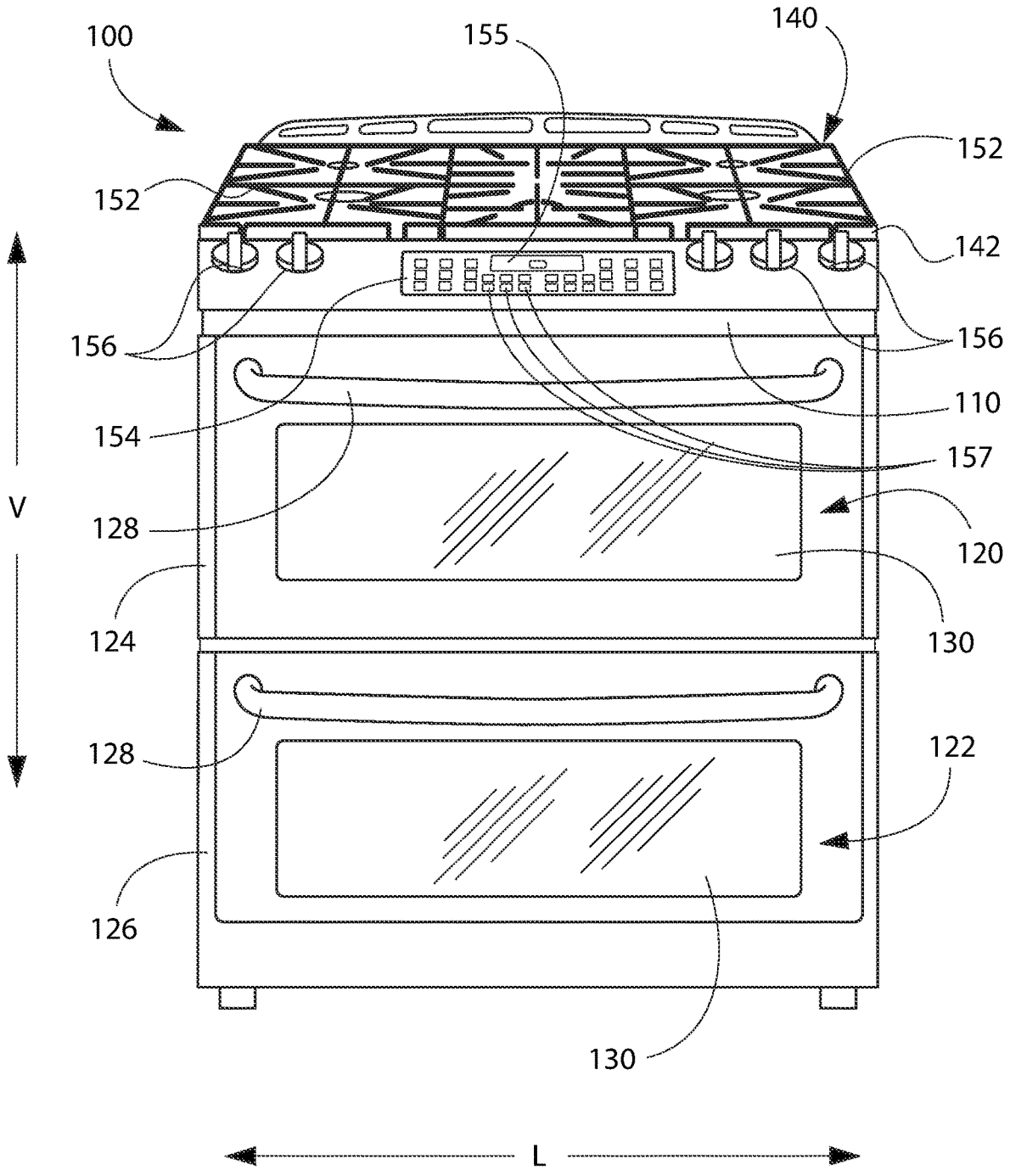
FIG. 1 provides a front, perspective view of a range appliance having a cooktop according to one or more example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
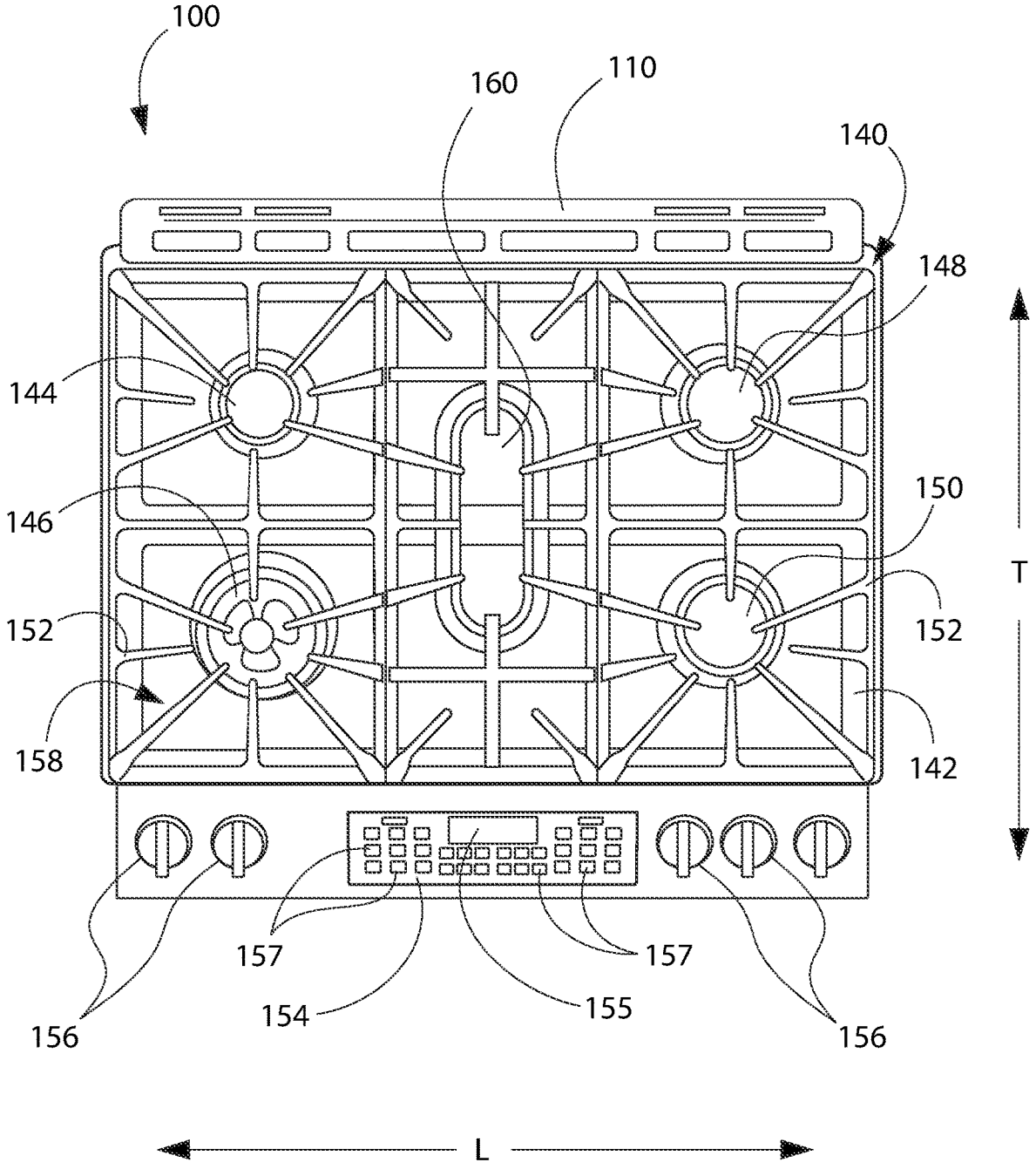
FIG. 2 provides a top, plan view of the example appliance of FIG. 1.

FIG. 1 provides a front, perspective view of a cooktop appliance 100 as may be employed with the present subject matter. FIG. 2 provides a top, plan view of cooktop appliance 100. As illustrated in FIGS. 1 and 2, the example cooktop appliance 100 includes an insulated cabinet 110. Cabinet 110 defines an upper cooking chamber 120 and a lower cooking chamber 122. Thus, this particular exemplary cooktop appliance 100 is generally referred to as a double oven range appliance. As will be understood by those skilled in the art, range appliance 100 is provided by way of example only, and the present subject matter may be used in any suitable cooktop appliance, e.g., a single oven range appliance or a standalone cooktop appliance. In other exemplary embodiments of the present disclosure, the cooktop appliance may include a single cooking chamber, or no cooking chamber at all, such as a standalone cooktop appliance, e.g., which may be built into a countertop. Thus, the example embodiment shown in FIG. 1 is not intended to limit the present subject matter to any particular cooking chamber configuration or arrangement (or even the presence of a cooking chamber at all, e.g., as in the case of a standalone cooktop appliance).

Upper and lower cooking chambers 120 and 122 are configured for the receipt of one or more food items to be cooked. Cooktop appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Cooktop appliance 100 also includes a cooktop 140. Cooktop 140 is positioned at or adjacent to a top portion of cabinet 110. Thus, cooktop 140 is positioned above upper and lower cooking chambers 120 and 122. Cooktop 140 includes a top panel 142. By way of example, top panel 142 may be constructed of glass, ceramics, stainless steel, enameled steel, and combinations thereof.

For cooktop appliance 100, a utensil 18 (see, e.g., FIGS. 3 and 4) holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 2, burner assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a cooking surface, e.g., top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, range appliance 100 also includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. The user interface panel 154 may also include one or more inputs 157, such as buttons or a touch pad, for selecting or adjusting operation of the range appliance 100, such as for selecting or initiating a precision cooking mode, as will be described in more detail below. User interface panel 154 may also be provided with one or more graphical display devices 155 that deliver certain information to the user such as e.g., whether a particular burner assembly is activated and/or the temperature at which the burner assembly is set.

Although shown with knobs 156, it should be understood that knobs 156 and the configuration of range appliance 100 shown in FIG. 1 is provided by way of example only. More specifically, range appliance 100 may include various input components, such as one or more of a variety of touch-type controls, electrical, mechanical or electro-mechanical input devices including rotary dials, push buttons, and touch pads. The user interface panel 154 may include other display components, such as a digital or analog display device 155, designed to provide operational feedback to a user.

As will be discussed in greater detail below, the cooktop appliance 100 includes a control system 50 (FIG. 4) for controlling one or more of the plurality of heating elements 16. Specifically, the control system 50 may include a controller 52 (FIGS. 3 and 4) operably connected to the user interface panel 154 and controls, e.g., knobs 156. The controller 52 may be operably connected to each of the plurality of heating elements 16 for controlling a power supply and/or flow of gaseous fuel to each of the plurality of heating elements 16 in response to one or more user inputs received through the interface panel 154 and controls.

Figure 3:
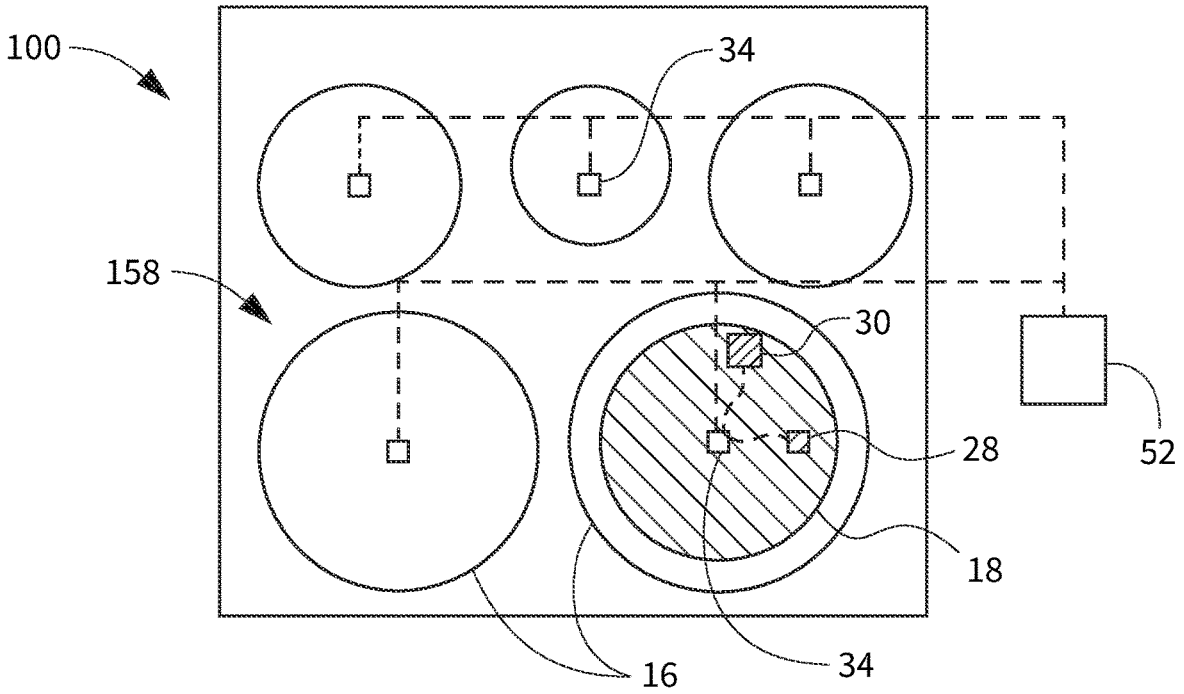
FIG. 3 is a schematic top view of an exemplary cooktop according to one or more example embodiments of the present subject matter which may be incorporated into a range appliance such as the range appliance of FIG. 1.

FIG. 3 is a schematic view of certain components of cooktop appliance 100. In particular, as shown in FIG. 3, cooktop appliance 100 includes a plurality of heating elements 16, which may be gas burners, e.g., as in the exemplary embodiments illustrated in FIGS. 1 and 2 and described above, or may be electric heating elements, such as induction heating elements or resistance heating elements.

FIG. 3 provides a top, schematic view of a cooktop, which may be, e.g., the cooktop 140 of FIG. 1. As stated, the cooking surface 158 of the cooktop 140 for the embodiment depicted includes five heating elements 16 spaced along the cooking surface 158. The heating elements 16 may be gas burners, e.g., as illustrated in FIGS. 1 and 2, or may be electric heating elements such as resistance heating elements or induction heating elements, etc. A cooking utensil 18, also depicted schematically, is positioned on a first heating element 16 of the plurality of heating elements 16. As noted above, the cooking utensil 18 may be positioned above the cooking surface 158, e.g., on a grate 152, in embodiments where the heating element 16 is a gas burner. In other embodiments, e.g., where the heating element 16 is a radiant electric heating element or an induction heating element, the cooking utensil 18 may be positioned directly on the cooking surface 158. Further, in embodiments where the heating element 16 is a coil electrical resistance heating element, the cooking utensil 18 may be positioned on the heating element 16. For the embodiment depicted, a cookware temperature sensor 28 and a food temperature sensor 30 are also associated with the cooking utensil 18.

Figure 4:
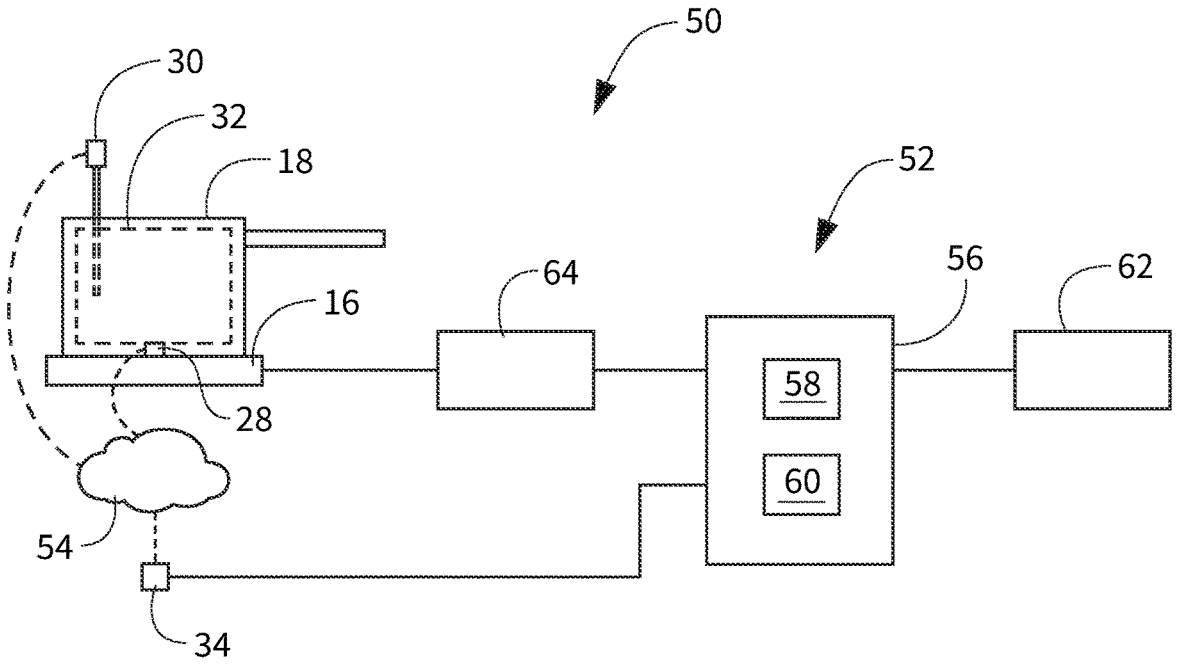
FIG. 4 provides a schematic diagram of a control system as may be used with the exemplary cooktop appliance of FIG. 3.

In some example embodiments, the cookware temperature sensor 28 may be in contact with, attached to, or integrated into the cooking utensil 18 and configured to sense a temperature of, e.g., a bottom surface of the cooking utensil 18 or bottom wall of the cooking utensil 18. For example, the cookware temperature sensor 28 may be embedded within the bottom wall of the cooking utensil 18 as illustrated in FIGS. 3 and 4. Alternatively, however, the cookware temperature sensor 28 may be attached to or integrated within the cooking surface 158 of the cooktop appliance 100. For example, the cookware temperature sensor 28 may be integrated into one or more of the heating elements 16. With such an exemplary embodiment, the cookware temperature sensor 28 may be configured to physically contact the bottom surface of a bottom wall of the cooking utensil 18 when the cooking utensil 18 is placed on the heating element 16 into which the temperature sensor 28 is integrated. Alternatively, cookware temperature sensor 28 may be positioned proximate to the bottom surface or bottom wall of the cooking utensil 18 when the cooking utensil 18 is placed on the heating element 16.

Additionally, the food temperature sensor 30 may be positioned at any suitable location to sense a temperature of one or more food items 32 (see FIG. 4) positioned within the cooking utensil 18. For example, the food temperature sensor 30 may be a probe type temperature sensor configured to be inserted into one or more food items 32. Alternatively, however, the food temperature sensor 30 may be configured to determine a temperature of one or more food items positioned within the cooking utensil 18 in any other suitable manner.

In certain exemplary embodiments, one or both of the cookware temperature sensor 28 and the food temperature sensor 30 may utilize any suitable technology for sensing/determining a temperature of the cooking utensil 18 and/or food items 32 positioned in the cooking utensil 18. The cookware temperature sensor 28 and the food temperature sensor 30 may measure a respective temperature by contact and/or non-contact methods. For example, one or both of the cookware temperature sensor 28 and the food temperature sensor 30 may utilize one or more thermocouples, thermistors, optical temperature sensors, infrared temperature sensors, resistance temperature detectors (RTD), etc.

Referring again to FIGS. 3 and 4, the cooktop appliance 100 additionally includes at least one receiver 34. In the illustrated example of FIG. 3, the cooktop appliance 100 includes a plurality of receivers 34, each receiver 34 associated with an individual heating element 16. Each receiver 34 is configured to receive a signal from the food temperature sensor 30 indicative of a temperature of the one or more food items 32 positioned within the cooking utensil 18 and/or from the cookware temperature sensor 28 indicative of a temperature of the cooking utensil 18 positioned on a respective heating element 16. In other embodiments, a single receiver 34 may be provided and the single receiver 34 may be operatively connected to one or more of the sensors. In at least some exemplary embodiments, one or both of the cookware temperature sensor 28 and the food temperature sensor 30 may include wireless transmitting capabilities, or alternatively may be hard-wired to the receiver 34, e.g., through a wired communications bus.

FIG. 4 provides a schematic view of a system for operating a cooktop appliance 100 in accordance with an exemplary embodiment of the present disclosure. Specifically, FIG. 4 provides a schematic view of a heating element 16 of the exemplary cooktop appliance 100 and an exemplary control system 50.

As stated, the cooktop appliance 100 includes a receiver 34 associated with one or more of the heating elements 16, for example a plurality of receivers 34 each associated with a respective heating element 16. For the embodiment depicted, each receiver 34 is positioned directly below a center portion of a respective heating element 16. Moreover, for the embodiment depicted, each receiver 34 is configured as a wireless receiver 34 configured to receive one or more wireless signals. Specifically, for the exemplary control system 50 depicted, both of the cookware temperature sensor 28 and the food temperature sensor 30 are configured as wireless sensors in wireless communication with the wireless receiver 34 via a wireless communications network 54. In certain exemplary embodiments, the wireless communications network 54 may be a wireless sensor network (such as a Bluetooth communication network), a wireless local area network (WLAN), a point-to point communication networks (such as radio frequency identification (RFID) networks, near field communications networks, etc.), a combination of two or more of the above communications networks, or any suitable wireless communications network or networks.

Referring still to FIG. 4, each receiver 34 associated with a respective heating element 16 is operably connected to a controller 52 of the control system 50. The receivers 34 may be operably connected to the controller 52 via a wired communication bus (as shown), or alternatively through a wireless communication network similar to the exemplary wireless communication network 54 discussed above. The controller 52 may generally include a computing device 56 having one or more processor(s) 58 and associated memory device(s) 60. The computing device 56 may be configured to perform a variety of computer-implemented functions to control the exemplary cooktop appliance 100. The computing device 56 can include a general purpose computer or a special purpose computer, or any other suitable computing device. It should be appreciated, that as used herein, the processor 58 may refer to a controller, a microcontroller, a microcomputer, a programmable logic controller (PLC), an application specific integrated circuit, and other programmable circuits. Additionally, the memory device(s) 60 may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory 60 can store information accessible by processor(s) 58, including instructions that can be executed by processor(s) 58. For example, the instructions can be software or any set of instructions that when executed by the processor(s) 58, cause the processor(s) 58 to perform operations. For the embodiment depicted, the instructions may include a software package configured to operate the system to, e.g., execute the exemplary methods described below.

Referring again to FIG. 4, the control system 50 additionally includes a user interface 62 operably connected to the controller 52. For the embodiment depicted, e.g., in FIG. 4, the user interface 62 is configured in wired communication with the controller 52. However, in other exemplary embodiments, the user interface 62 may additionally or alternatively be wirelessly connected to the controller 52 via one or more suitable wireless communication networks (such as the exemplary wireless communication network 54 described above). In certain exemplary embodiments, user interface 62 may be configured as the user interface panel 154 and plurality of controls, e.g., knobs 156, on the cooktop appliance 100 (see, e.g., FIG. 1). Additionally, or alternatively, the user interface 62 may be configured as an external computing device or remote user interface device, such as a smart phone, tablet, or other device capable of connecting to the controller 52 of the exemplary control system 50. For example, in some embodiments, the remote user interface may be an application or "app" executed by a remote user interface device such as a smart phone or tablet. Signals generated in controller 52 operate the cooktop appliance 100 in response to user input via the user interface 62.

Further, the controller 52 is operably connected to each of the plurality of heating elements 16 for controlling an operating level, such as a supply of power or a flow of fuel, to each of the plurality of heating elements 16 in response to one or more user inputs through the user interface 62 (e.g., user interface panel 154 and/or controls, e.g., knobs 156). For example, the controller 52 may be operably connected to each of the plurality of heating elements 16 via a plurality of control devices 64, e.g., the controller 52 may be operably connected to the plurality of control devices 64, and each control device 64 may be associated with a respective one of the heating elements 16. In embodiments wherein one or more of the heating elements 16 are configured as electric resistance heaters, the controller 52 may be operably connected to respective relays, triodes for alternating current, or other devices for controlling an amount of power supplied to such electrical resistance heaters, each of which is an exemplary embodiment of control devices 64. Alternatively, in embodiments where one or more of the heating elements 16 are configured as induction heating elements, the controller 52 may be operably connected to respective current control devices, e.g., the control devices 64 operably connected to controller 52 may be respective current control devices for each induction heating element. As another example, in embodiments wherein one or more of the heating elements 16 are configured as gas burners, the control devices 64 may include one or more gas supply valves fluidly coupled to each gas burner for selectively adjusting or restricting, e.g., cutting off, a flow of fuel to each gas burner from a fuel supply.

According to various embodiments of the present disclosure, the cooktop appliance 100 may be configured for a precision cooking mode and/or methods of operating the cooktop appliance 100 may include precision cooking mode. Precision cooking mode generally includes a closed-loop control algorithm used to automatically (e.g., without user input such as adjusting the knobs 156) adjust the heating levels of one or more of the heating elements 16. Utilizing temperature measurements from one or both of the temperature sensors 28 and 30, controller 52 may adjust the control device(s) 64 associated with the heating element 16 currently in use. For example, the user may turn on the closed loop control system by initiating precision cooking mode, such as by pressing or otherwise manipulating a corresponding one of the inputs or controls of the user interface 62. Such inputs and/or controls of the user interface 62 may also be used to input a user-defined set temperature or target temperature for the cooking operation.

When the closed loop control system is activated, controller 52 receives the temperature measurements from temperature sensor 28 and/or 30 and compares the temperature measurements to a target temperature, e.g., the user-defined set temperature. In order to reduce a difference between the temperature measurements from the temperature sensor 28 and/or 30 and the set temperature, controller 52 adjusts the respective control device 64. Thus, the heat output provided by the heating element 16 may be regulated by the closed loop control system, e.g., without additional user input and/or monitoring.

A user may establish the set temperature via the user interface 62, e.g., the user interface may include knobs 156, inputs 157, and a display 155, as in the illustrated example embodiment of FIG. 2. Controller 52 is in communication with user interface 62 and is configured to receive the user-determined set temperature from user interface 62. User interface 62 may correspond to user interface panel 154 and/or controls, e.g., knobs 156, in certain example embodiments. Thus, the user may, for example, utilize keys 157 on user interface panel 154 and/or a rotary position of one of the knobs 156 to establish the set temperature. In such example embodiments, user interface 62 is positioned on top panel 142 and may be in communication with controller 52 via a wiring harness. As another example, user interface 62 may also or instead correspond to an application on a smart phone or other device, and the user may utilize the application to establish the set temperature. In such example embodiments, user interface 62 may be in wireless communication with controller 52, e.g., via a Bluetooth® or Wi-Fi® connection.

Figure 5:
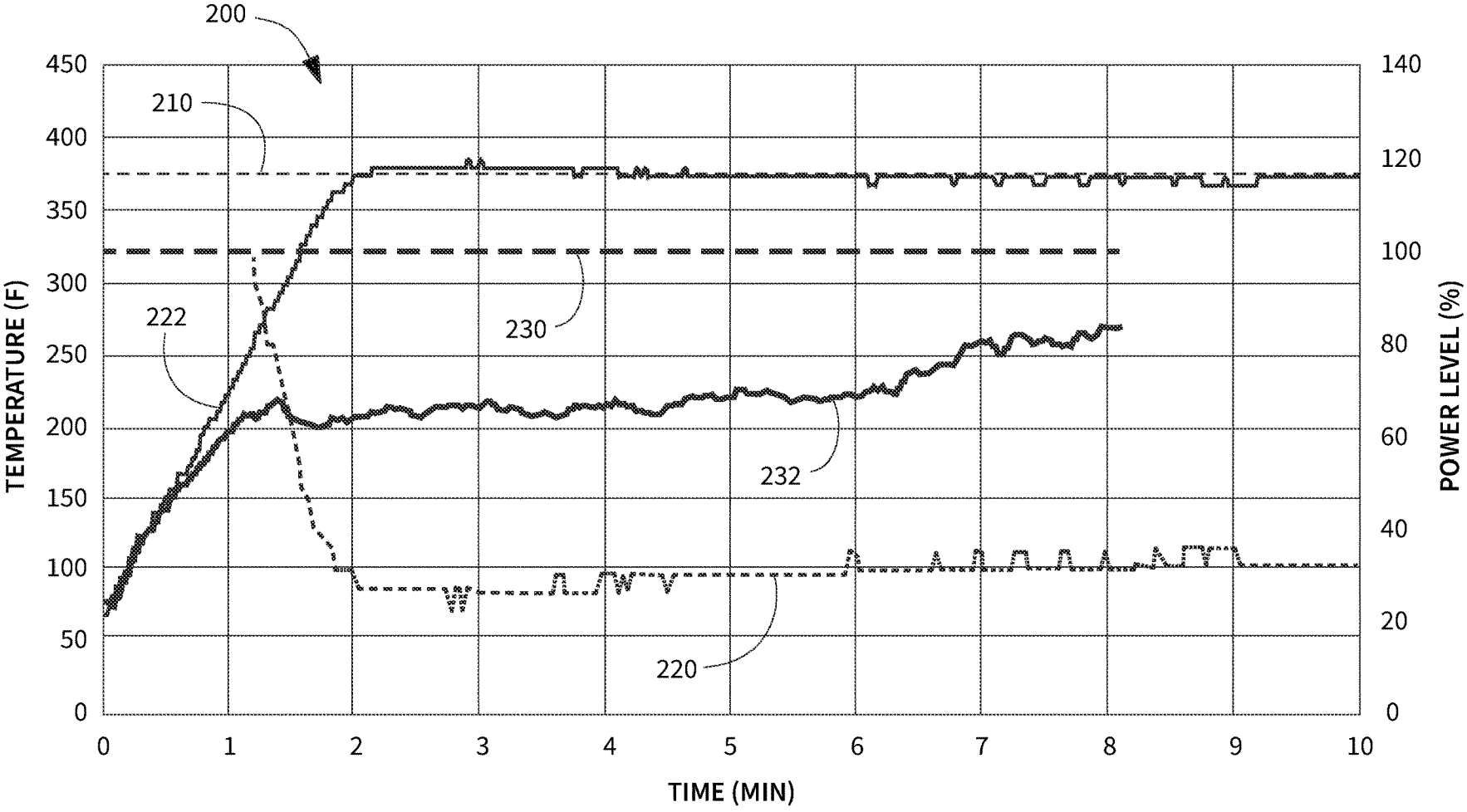
FIG. 5 provides a graph of temperatures and power levels over time during exemplary cooking operations.

A graph 200 of temperature and heating element power over time in multiple exemplary closed-loop (e.g., precision mode) cooking operations, which do not include a vaporization timer or other vaporization-responsive features, is illustrated in FIG. 5. In particular, graph 200 illustrates two closed-loop cooking operations and includes a target temperature or set temperature 210, which is the same for both cooking operations, e.g., is about 375° Fahrenheit in the illustrated example. FIG. 5 illustrates a first power level 220 and a first temperature 222 from a first operation, in which vaporization does not occur or an insignificant amount of vaporization occurs. A second power level 230 and a second temperature 232 are also illustrated in FIG. 5, and represent an exemplary cooking operation during which a significant amount of liquid, e.g., water, vaporizes from the food items being cooked. The first temperature 222 and the second temperature 232 may each be actual temperatures, such as temperature values measured and/or monitored with one or more temperature sensors, e.g., as described above with reference to FIGS. 3 and 4, during the first and second cooking operations. The first and second power levels 220 and 230 may be outputs of closed-loop algorithms. As may be seen in the graph 200 of FIG. 5, the first power level 220 varies over time, whereas the second power level 230 is more constant, e.g., the closed-loop control algorithm for the second cooking operation continues to call for a high level of heating, e.g., operating the heating element at or about 100% power, because the temperature 232 remains well below the set temperature 210, e.g., for several minutes, such as at least from about 1.5 minutes to about 6 minutes as illustrated in FIG. 5. For example, when the cooking operation includes an integral term ("I term"), the integral term may continue to accumulate during an extended time period while the actual temperature is below the set temperature, even though the heat in the system may in fact be increasing, e.g., when the latent heat of vaporization is considered. The continued high (e.g., at or about 100%) power level may result in overcooking, overheating, and/or splatter issues.

Accordingly, those of ordinary skill in the art will recognize that a closed-loop cooking operation including vaporization-responsive features may advantageously provide a more moderate, e.g., lower, temperature and/or heating element power level for the cooking operation, e.g., while water is vaporizing from the food items being cooked. For example, the exemplary methods described herein, such as method 500 described below, may advantageously provide a lower heating element power level for a given set temperature as compared to operations such as those illustrated in FIG. 5 and described above, thereby avoiding or reducing instances of overcooking, overheating, and/or splatter. The advantages described herein are set forth by way of example only and are not to be limiting. Of course, it is to be understood that not necessarily all such objects or advantages described in and throughout this disclosure may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Figure 6:
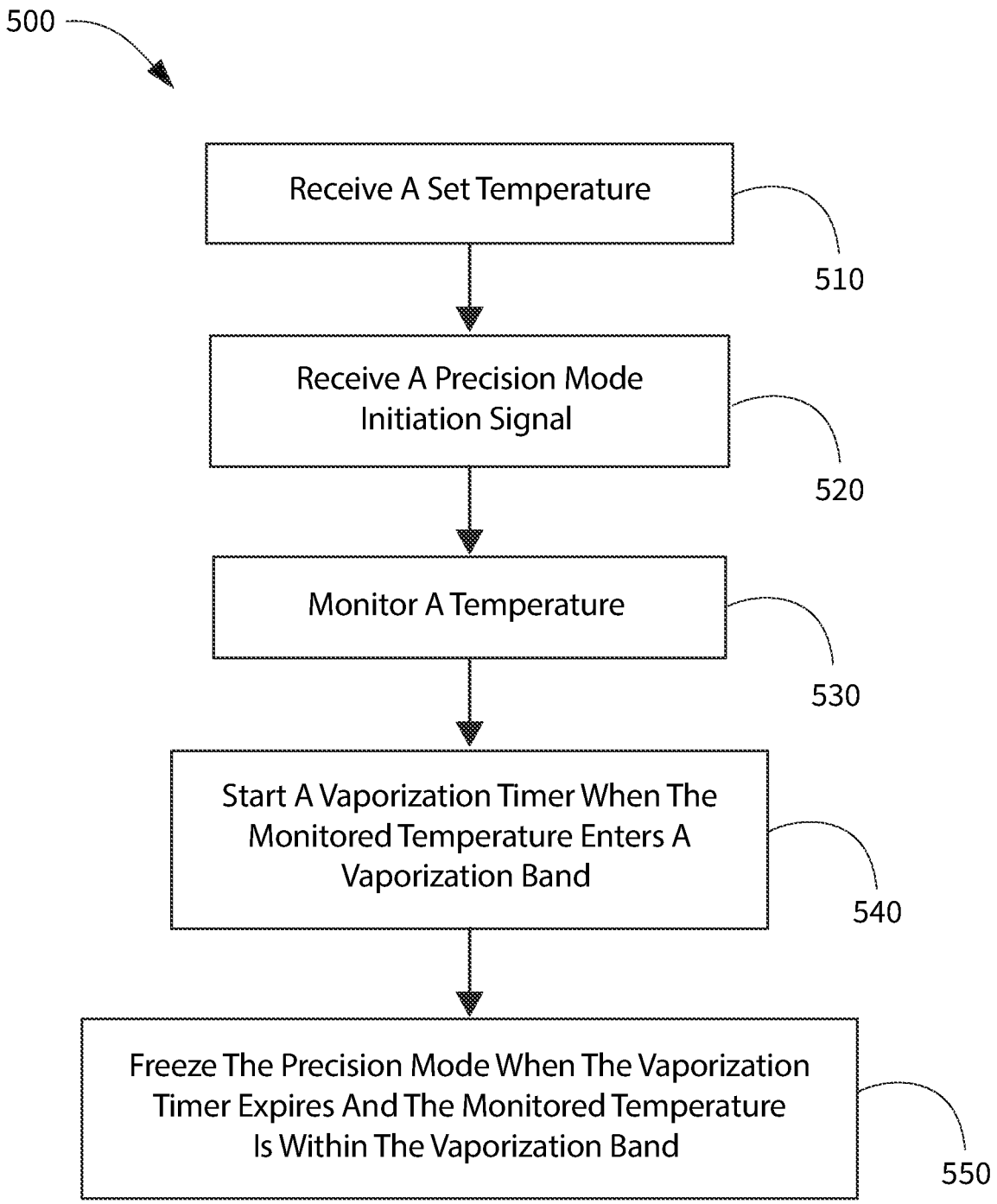
FIG. 6 provides a flow chart illustrating an exemplary method of operating a cooktop appliance according to one or more example embodiments of the present subject matter.

Turning now to FIG. 6, an example method 500 of operating a cooktop appliance, such as the example appliance 100 described above, is illustrated. The method 500 may include a step 510 of receiving a user-determined target temperature or set temperature from a user interface, e.g., user interface 62, of the cooktop appliance. The user-determined set temperature may be directly input by the user, e.g., as a numerical value for the desired cooking temperature, and/or may be derived from one or more inputs such as food type, food quantity, and/or cooking technique, etc. The method 500 may also include a step 520 of receiving a precision mode initiation signal. The precision mode initiation signal may be received from the user interface, e.g., user interface panel 154 and/or knobs 156. The precision mode initiation signal may represent or correspond to a user request for precision cooking mode based on a user pressing a precision cooking mode key or button 157 or otherwise entering the request via the user interface 62. It will be understood that the precision cooking mode includes a target temperature, e.g., the user-determined set temperature received from the user interface at step 510. The set temperature may be directly user-determined, e.g., a user may input or select a target temperature value via user interface 62. In additional embodiments, the target temperature may also or instead be indirectly user-determined, e.g., the target temperature may be derived from a user input including one or more of food type, food quantity, cooking technique, or other such input received from the user interface 62.

The precision cooking mode utilizes a closed-loop control system, which may operate or adjust the cooktop appliance based on input from a temperature sensor. Thus, exemplary embodiments of the method 500 may also include receiving a temperature measurement from the temperature sensor and thereby monitoring the temperature at the utensil heated by the heating element with the temperature sensor, e.g., as indicated at 530, in FIG. 6.

The method 500 may further include inputting the user-determined set temperature and a current temperature measurement into the closed-loop control algorithm. The current temperature measurement may be measured with the temperature sensor. For example, the current temperature measurement may be measured with one or both of the temperature sensors 28 and 30 described above, or one or more other suitable temperature sensor(s). Additionally, the temperature may be monitored over a time period, such as throughout the precision mode, e.g., the current temperature measurement may be iterated or repeated and the closed-loop algorithm updated accordingly (such as inputting the iterated or repeated then-current temperature measurements into the algorithm and generating additional outputs from the algorithm, as described below) throughout the precision cooking mode operation.

Further, method 500 may include determining an output of the closed-loop control algorithm and adjusting operation of the heating element according to the output of the closed-loop control algorithm. Thus, those of ordinary skill in the art will recognize that the precision cooking mode generally includes automated operation of the heating element according to the closed-loop control based on the set temperature and temperature feedback, e.g., multiple temperature measurements each of which reflects a then-current temperature, over time throughout the precision cooking mode operation. Further, those of ordinary skill in the art will understand that such closed-loop control generally includes comparing the current temperature measurement to the user-determined set temperature and generating the output of the closed-loop algorithm based on the comparison of the current temperature measurement to the user-determined set temperature using the set of parameters of the closed-loop algorithm corresponding to the starting temperature. Such comparing and output-generating steps may be repeated, e.g., continuously, and the heating level of the heating element adjusted accordingly, throughout the precision cooking mode operation.

As mentioned above, the heating elements 16 may be any suitable type of heating element. For example, in some embodiments, the heating element may be or include a gas burner. In such embodiments, adjusting the heating level of the heating element according to the output of the closed-loop control algorithm may include adjusting a position of a fuel supply valve coupled to the gas burner. As another example, in additional embodiments, the heating element 16 may also or instead be or include an electric heating element. In such embodiments, adjusting the heating level of the heating element according to the output of the closed-loop control algorithm may include adjusting a level of electric power supplied to the heating element.

In some embodiments, method 500 may include a step 540 of starting a vaporization timer when the monitored temperature enters a vaporization band. The vaporization band may be a temperature range which corresponds to or indicates water and other similar liquid constituents (e.g., mixtures of water with other substances and/or other liquids having a similar boiling point or vaporization temperature as water) vaporizing from the food item(s) 32 (FIG. 4) in the cooking utensil 18 (FIGS. 3 and 4). Accordingly, the vaporization band may include, e.g., be centered around, the boiling point of water, such as about two hundred and twelve degrees Fahrenheit (212° F.).

Thus, when the monitored temperature is stuck or lags in the vaporization band, the precision cooking mode, e.g., closed-loop algorithm, may call for increased heating because the temperature is not increasing as expected, although the heat of the food item(s) 32 and cooking utensil 18 may nevertheless be increasing, e.g., due to the latent heat of vaporization. As such, the increased heating which the precision mode may call for in such circumstances may be more than is needed. For example, cooking with a higher power level than needed and/or more heat than needed may lead to undesirable results, such as the food items may be more likely to boil over or splatter, in particular when the food items are or include oil. The increased likelihood of boil over or splatter may, for example, be due to the increased kinetic energy of the food item molecules, e.g., water molecules, and increased water vaporization rate from the higher heat. Thus, it may be advantageous to freeze the precision mode when the monitored temperature remains within the vaporization band for a period of time, such as for at least the vaporization timer length. For example, a more moderate cooking power may be provided when the precision mode is frozen during the vaporization band, as compared to continuing to update or iterate the closed-loop control algorithm of the precision cooking mode during the vaporization band. Such moderate power may, for example, result in more moderate overall food temperature, especially when the amount of water is reduced, preventing or reducing the chance of overcooking. For example, cooking ground beef at moderate temperatures may, e.g., reduce shrinkage and help retain juices and flavor, whereas overcooking may, for example, draw out more fat and juices from ground beef, resulting in a drier, less tasty product. In some embodiments, the vaporization timer may be between about forty five seconds and about one hundred fifty seconds, such as between about sixty seconds and about one hundred twenty seconds, such as about ninety seconds.

For example, as illustrated in FIG. 6, the exemplary method 500 may, in some embodiments, include a step 550 of freezing the precision mode when the vaporization timer expires and the monitored temperature is within the vaporization band. In some embodiments, the precision cooking mode may be or include a closed-loop control algorithm, as described above. In such embodiments, the closed-loop control algorithm may include an integral term ("I term"), for example, the closed-loop control algorithm may be a proportional-integral (PI) control loop or a proportional-integral-derivative (PID) control loop. The integral term (also referred to as the "I term") represents or corresponds to the error or deviation from the control value, e.g., the difference between the current sensor temperature and the target temperature, and the I term accumulates over time, e.g., resulting in an increasing call for power the longer the monitored temperature remains below the target temperature and/or a continually decreasing call for power over time as long as the monitored temperature remains above the target temperature. Freezing the precision mode may include storing one or more then-current (e.g., current at the moment that the vaporization timer expires) values of the control algorithm terms in a memory, e.g., of the controller of the cooktop appliance, thereby halting the accumulation of the error values and avoiding or minimizing continued escalation of the called-for heating values output by the control algorithm. For example, freezing the precision mode may include storing at least the then-current value of the I term in the memory. In some embodiments, the precision mode may be subsequently resumed or unfrozen, in which case the precision mode may resume calculating the I term of the control algorithm, such as PI control algorithm or PID control algorithm, etc., with the values of the terms that were stored in the memory when the precision mode was frozen, such as the I term may continue where it left off when the precision mode was frozen. In other embodiments, the I term may be set to a predetermined value when the precision mode resumes or is unfrozen.

In some embodiments, a method of operating a cooktop appliance according to one or more exemplary embodiments of the present disclosure may include operating the heating element at a predetermined override power level after freezing the precision mode. For example, the override power level may be determined by the output of a closed-loop control algorithm similar to the precision cooking mode with different, e.g., lower, parameters, to provide reduced power levels during vaporization (e.g., when the temperature remains within the vaporization band for longer than the vaporization timer) as compared to what the precision cooking mode would call for. In other embodiments, the override power level may be or include one or more fixed or constant power levels, such as a predetermined percentage value, e.g., where 100% power corresponds to maximum power. For example, the override power level may be between about twenty-five percent (25%) power and about ninety percent (90%) power, such as between about thirty percent (30%) power and about eighty five percent (85%) power, such as between about forty percent (40%) power and about eighty percent (80%) power, such as between about fifty percent (50%) power and about seventy five percent (75%) power, such as between about sixty percent (60%) power and about seventy percent (70%) power.

In some embodiments, the override power level may be proportional to the user-determined set temperature, such as the override power level may be about 50% power when the set temperature is about 250° F. or less, and the override power level may be about 75% power when the set temperature is about 500° F. or greater. In such embodiments, the override power level may be an intermediate value between 50% power and 75% power when the set temperature is between 250° F. and 500° F., such as the override power level may be interpolated based on the intermediate set temperature relative to the temperature range. In some embodiments, a lookup table comprising user-determined set temperature values and corresponding override power level percentages may be stored, e.g., in a memory of the controller of the cooktop appliance and/or in a remote computing device with which the controller communicates, e.g., over the internet or a local network, and the override power level may be determined by looking up the user-determined set temperature in the lookup table and applying the override power level associated with the user-determined set temperature in the lookup table as the override power level and/or by interpolating between the two nearest user-determined set temperature values in the lookup table to determine the override power level.

In some embodiments, the method may include operating the heating element at the predetermined override power level for the remainder of the cooking operation, e.g., until the user turns the heating element off manually. In other embodiments, the method may include operating the heating element at the predetermined override power level for a portion of the cooking operation, followed by another portion of the cooking operation in which the precision cooking mode, e.g., closed-loop control algorithm, is restored or unfrozen.

In some embodiments, exemplary methods of operating a cooktop appliance may also include, after the monitored temperature enters the vaporization band, calculating a difference between the monitored temperature and the user-defined set temperature, comparing the difference between the monitored temperature and the user-defined set temperature to a minimum allowed temperature error, and cancelling the vaporization timer when the monitored temperature deviates from the user-defined set temperature by less than the minimum allowed temperature error, e.g., when the calculated difference between the monitored temperature and the user-defined set temperature is less than the minimum allowed temperature error. Cancelling the vaporization timer as described herein may advantageously prevent or minimize false positives, e.g., when the target temperature is too close to the water vaporization temperatures. In those situations, even when no vaporization is occurring, the temperature could stall inside the vaporization band, because it has reached the set temperature inside the band.

As mentioned above, the vaporization band may be a range of temperatures including the boiling point of water (about 212° F.). For example, in some embodiments, the vaporization band may include a vaporization band lower limit and a vaporization band upper limit. In such embodiments, the monitored temperature enters the vaporization band when the monitored temperature is greater than or equal to the vaporization band lower limit, and the monitored temperature remains within the vaporization band as long as the monitored temperature is greater than or equal to the vaporization band lower limit and less than or equal to the vaporization band upper limit. In some embodiments, the vaporization band lower limit may be about one hundred and eighty degrees Fahrenheit (180° F.) and the vaporization band upper limit may be about two hundred fifty degrees Fahrenheit (250° F.). For example, the vaporization band lower limit may be between about one hundred and sixty degrees Fahrenheit (160° F.) and about two hundred degrees Fahrenheit (200° F.), such as between about one hundred and seventy degrees Fahrenheit (170° F.) and about one hundred and ninety degrees Fahrenheit (190° F.). Also by way of example, the vaporization band upper limit may be between about two hundred twenty degrees Fahrenheit (220° F.) and about two hundred and seventy degrees Fahrenheit (270° F.), such as between about two hundred thirty degrees Fahrenheit (230° F.) and about two hundred and sixty degrees Fahrenheit (260° F.), such as about two hundred and forty degrees Fahrenheit (240° F.) or about two hundred fifty degrees Fahrenheit (250° F.).

In some embodiments, exemplary methods of operating a cooktop appliance may also include starting a vaporization exit timer when the monitored temperature exits the vaporization band and unfreezing the precision mode when the vaporization exit timer expires and the monitored temperature is above the vaporization band. Thus, the method may include ensuring that the monitored temperature is outside of, e.g., above, the vaporization band for a minimum time, e.g., the vaporization exit timer duration, before resuming the precision cooking mode. The minimum time outside of the vaporization band may verify that vaporization has ended. The vaporization exit timer may be between about fifteen seconds and about sixty seconds, such as about thirty seconds.

In some embodiments the monitored temperature which is tracked relative to the vaporization band, e.g., to determine when the temperature enters, remains in, and/or exits the vaporization band, may be an instantaneous temperature measurement and/or a plurality of instantaneous temperature measurements. In additional embodiments, the monitored temperature may be averaged, such as a moving average, over a certain time frame and the average temperature may be tracked relative to the vaporization band. For example, the moving average temperature may be a three-second moving average, a four-second moving average, a five-second moving average, or may be averaged over a longer period of time, such as about six seconds or about ten seconds, etc., or may be a two-second moving average temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:
- a user interface;
- a heating element positioned at a cooking surface of the cooktop appliance;
- a temperature sensor configured to measure a temperature at a utensil heated by the heating element; and
- a controller, the controller configured for:
  - receiving a user-determined set temperature from the user interface;
  - receiving a precision mode initiation signal;
  - monitoring the temperature at the utensil heated by the heating element with the temperature sensor;
  - starting a vaporization timer when the monitored temperature enters a vaporization band; and
  - freezing the precision mode when the vaporization timer expires and the monitored temperature is within the vaporization band.

2. The cooktop appliance of claim 1, wherein the controller is further configured for operating the heating element at a predetermined override power level after freezing the precision mode.

3. The cooktop appliance of claim 1, wherein the controller is further configured for, after the monitored temperature enters the vaporization band, calculating a difference between the monitored temperature and the user-determined set temperature, comparing the difference between the monitored temperature and the user-determined set temperature to a minimum allowed temperature error, and cancelling the vaporization timer when the calculated difference between the monitored temperature and the user-determined set temperature is less than the minimum allowed temperature error.

4. The cooktop appliance of claim 1, wherein the monitored temperature enters the vaporization band when the monitored temperature is greater than or equal to a vaporization band lower limit, and the monitored temperature is within the vaporization band as long as the monitored temperature is greater than or equal to the vaporization band lower limit and less than or equal to a vaporization band upper limit.

5. The cooktop appliance of claim 1, wherein the controller is further configured for starting a vaporization exit timer when the monitored temperature exits the vaporization band and unfreezing the precision mode when the vaporization exit timer expires and the monitored temperature is above the vaporization band.

6. The cooktop appliance of claim 1, wherein the precision mode comprises operating the heating element at a power level determined by an output of a closed-loop control algorithm.

7. The cooktop appliance of claim 6, wherein the closed-loop control algorithm is a control algorithm comprising an integral term.

8. The cooktop appliance of claim 7, wherein freezing the precision mode comprises storing a current value of the integral term when the vaporization timer expires and the monitored temperature is within the vaporization band, further comprising unfreezing the precision mode when the monitored temperature exits the vaporization band, wherein unfreezing the precision mode comprises determining the output of the closed-loop control algorithm according to the stored value of the integral term.

9. The cooktop appliance of claim 6, wherein the heating element comprises a gas burner, and wherein operating the heating element at the power level determined by the output of the closed-loop control algorithm comprises adjusting a position of a fuel supply valve coupled to the gas burner.

10. The cooktop appliance of claim 6, wherein the heating element comprises an electric heating element, and wherein operating the heating element at the power level determined by the output of the closed-loop control algorithm comprises adjusting a level of electric power supplied to the heating element.

11. A method of operating a cooktop appliance, the cooktop appliance comprising a user interface, a heating element positioned at a cooking surface of the cooktop appliance, and a temperature sensor configured to measure a temperature at a utensil heated by the heating element, the method comprising:

receiving a user-determined set temperature from a user interface of the cooktop appliance;

receiving a precision mode initiation signal;

monitoring the temperature at the utensil heated by the heating element with the temperature sensor;

starting a vaporization timer when the monitored temperature enters a vaporization band; and freezing the precision mode when the vaporization timer expires and the monitored temperature is within the vaporization band.

12. The method of claim 11, further comprising operating the heating element at a predetermined override power level after freezing the precision mode.

13. The method of claim 11, further comprising, after the monitored temperature enters the vaporization band, calculating a difference between the monitored temperature and the user-determined set temperature, comparing the difference between the monitored temperature and the user-determined set temperature to a minimum allowed temperature error, and cancelling the vaporization timer when the calculated difference between the monitored temperature and the user-determined set temperature is less than the minimum allowed temperature error.

14. The method of claim 11, wherein the monitored temperature enters the vaporization band when the monitored temperature is greater than or equal to a vaporization band lower limit, and the monitored temperature is within the vaporization band as long as the monitored temperature is greater than or equal to the vaporization band lower limit and less than or equal to a vaporization band upper limit.

15. The method of claim 11, further comprising starting a vaporization exit timer when the monitored temperature exits the vaporization band and unfreezing the precision mode when the vaporization exit timer expires and the monitored temperature is above the vaporization band.

16. The method of claim 11, wherein the precision mode comprises operating the heating element at a power level determined by an output of a closed-loop control algorithm.

17. The method of claim 16, wherein the closed-loop control algorithm is a control algorithm comprising an integral term.

18. The method of claim 17, wherein freezing the precision mode comprises storing a current value of the integral term when the vaporization timer expires and the monitored temperature is within the vaporization band, further comprising unfreezing the precision mode when the monitored temperature exits the vaporization band, wherein unfreezing the precision mode comprises determining the output of the closed-loop control algorithm according to the stored value of the integral term.

19. The method of claim 16, wherein the heating element comprises a gas burner, and wherein operating the heating element at the power level determined by the output of the closed-loop control algorithm comprises adjusting a position of a fuel supply valve coupled to the gas burner.

20. The method of claim 16, wherein the heating element comprises an electric heating element, and wherein operating the heating element at the power level determined by the output of the closed-loop control algorithm comprises adjusting a level of electric power supplied to the heating element.

* * * * *